United States Patent [19]

Leroy et al.

[11] 3,985,350

[45] Oct. 12, 1976

[54] CONVERTER

[75] Inventors: Pierre Leroy, Saint-Germain-en-Laye; Emile Sprunck, Moyeuvre-Grande, both of France

[73] Assignees: Emile Sprunck, Moyeuvre-Grande; Creusot-Loire, Paris, both of France

[22] Filed: Sept. 19, 1975

[21] Appl. No.: 615,081

[30] Foreign Application Priority Data

Sept. 20, 1974 France ..... 74.31758

[52] U.S. Cl. ..... 266/218; 266/265; 266/268

[51] Int. Cl.[2] ..... C21C 5/48; C21B 7/16

[58] Field of Search ..... 75/59, 60; 266/35, 36 P, 266/41, 218, 222, 265, 268, 270

[56] References Cited

UNITED STATES PATENTS

| | | | |
|---|---|---|---|
| 3,330,645 | 7/1967 | De Moustier et al. | 266/35 X |
| 3,819,165 | 6/1974 | Courard et al. | 266/41 |
| 3,895,785 | 7/1975 | Kolb et al. | 266/35 |

*Primary Examiner*—Roy Lake
*Assistant Examiner*—Paul A. Bell
*Attorney, Agent, or Firm*—Haseltine, Lake & Waters

[57] ABSTRACT

In a steelworks converter including blast-pipes protected by a flow of hydrocarbons, a device is provided for retaining the hydrocarbons, the device comprising a retaining assembly forming a cup on the bottom plate of the converter and having substantially the same area as the bottom plate, and a seal for sealing around the blast pipes where they project through the base of the cup.

8 Claims, 3 Drawing Figures

CONVERTER

The present invention relates to improvements in converters and particularly to a device for retention of hydrocarbon gases, liquids or pastes or any other flowable product, such as tar used in the construction of converter bottoms. The device is to be placed directly on the bottom plate of the steelworks converter in the case of converters employing double or multiple blast-pipes protected by a peripheral flow of a protective medium.

Media for protection of double or multiple converter-bottom blast-pipes may be gaseous, liquid or viscous. Usually hydrocarbons are employed. A proportion of these hydrocarbons issuing from the peripheral tubes of the blast-pipes runs into the mass of the converter bottom which is generally of tarred dolomite and sometimes of magnesia. This flow of hydrocarbons leaks through at various points, such as the periphery of the bottom plate, the points where the blast-pipes pass through the bottom plate, and holes which may occur accidentally in the shell of the converter.

An object of the present invention is to prevent these leaks and hence their consequences. To this end it is an object of the present invention to provide a device comprising a retainer cup arranged on the bottom plate of the converter and substantially equal in size to the bottom plate.

The retainer cup may comprise a sheet bent round into a cylinder the cross-section of which is substantially equal to the area of the converter bottom plate. The cylinder may be of any height.

Alternatively, the retainer cup may comprise a thin disc of the same size as the converter bottom plate and placed on the bottom plate to form a bottom of said cup, and a strip bent into a cylinder of the same dimensions as said bottom plate and said disc, said strip being cold-crimped onto said disc, said cup as a whole being placed on the bottom plate.

Each of the blast-pipes may be surrounded by a tube of the same height as the retainer cup, either welded directly to the bottom plate, where this forms the bottom of the cup, or screwed onto the disc constituting the bottom of the cup. Above these short tubes a baffle of umbrella shape may advantageously be provided, the baffle being welded to the outer tube of the blast-pipe for obstructing entry of the hydrocarbons into the tubes.

Alternatively, the outer tube of each blast-pipe may have a cuff or ring welded thereto which engages the upper surface of the bottom plate or the disc forming the bottom of the cup, this cuff having a recess in its lower surface in which is seated a seal, e.g. a cord of asbestos or any other material, the oiltight engagement of the cuff onto the bottom plate being affected by a nut arranged underneath the bottom plate and engaging a threaded portion of the outer tube of the blast-pipe.

Materials suitable for the retainer cup are sheet steel, aluminum or aluminum alloy, cardboard, paper or plastic materials.

The invention will be more fully understood from the following description of an embodiment thereof for a converter bottom of tarred dolomite, given by way of example only, with reference to the accompanying drawings.

Figure 1:
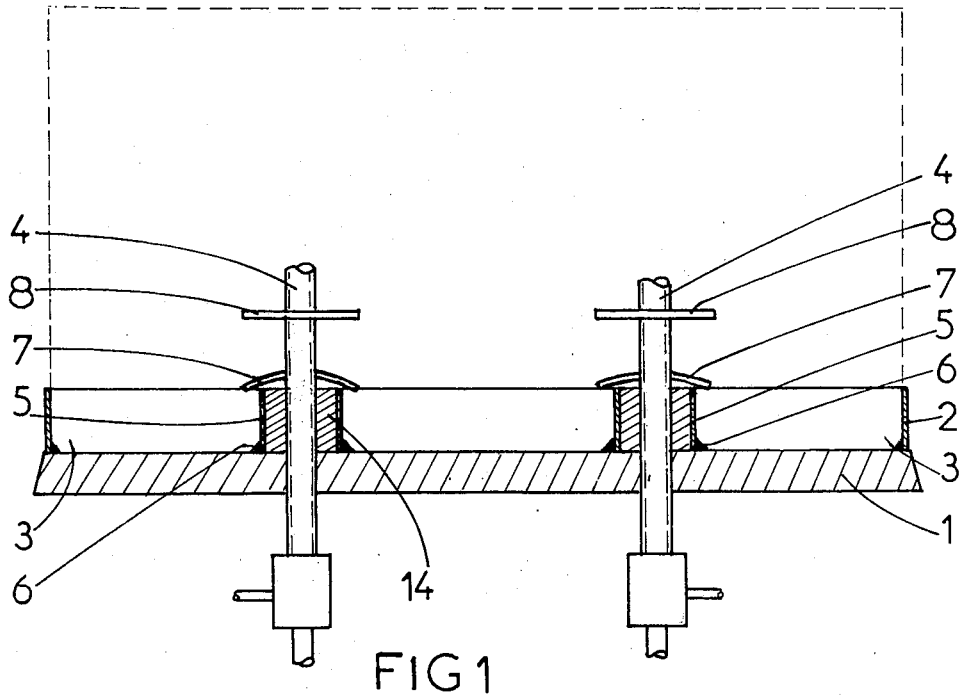
FIG. 1 is a vertical section through a first embodiment of a retainer cup in accordance with the invention.

In the embodiment shown in FIG. 1, the bottom of the retainer cup is provided by the converter bottom plate 1. The retainer cup 2 consists of a sheet bent round in a circle to constitute a cylinder of about 200mm in height and which is welded at 3 onto the circumference of the bottom plate 1.

Each blast-pipe 4 consists of two concentric tubes, oxygen being supplied to the central tube and fuel oil being supplied between the tubes. Each blast-pipe is surrounded by a short tube 5 welded at 6 to the bottom plate 1. Each of these short tubes 5 is surmounted by a baffle 7 in the shape of an umbrella which covers the tube so as to obstruct entry of hydrocarbons into the tube 5 which is filled with a grout 14 before the dolomite is put in position. Other flat baffles such as 8 are welded at intervals along and to the outer tube of each blast-pipe.

Figure 2:
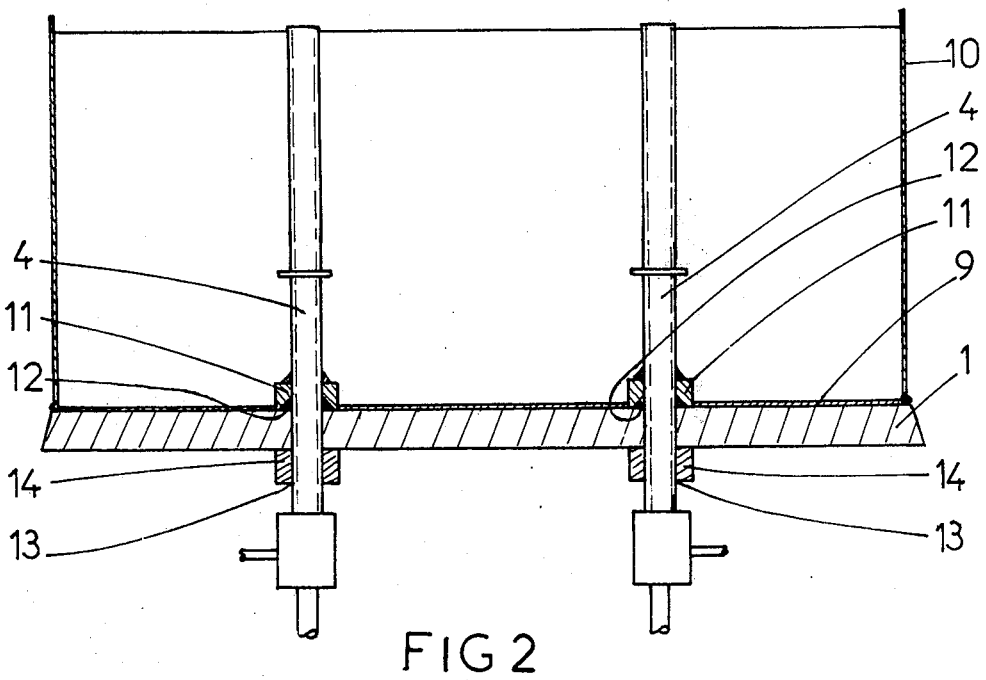
FIG. 2 is a vertical section through a second embodiment of a retainer cup in accordance with the invention.

In the second embodiment shown in FIG. 2 the retainer cup is prefabricated and placed on the bottom plate 1. The cup consists of a circular disc 9 of the same area as the bottom plate, onto which is cold-crimped a thin steel sheet 10 of thickness of 0.8mm and of the same height as the refractory bottom to constitute a cylindrical cladding for the refractory bottom.

An annular member in the form of a cuff or ring 11 is welded to the outer tube of each of the blast-pipes. This ring 11 has in its lower surface a recess in which is seated a cord 12 of asbestos (or of any other material) forming a seal between the ring 11 and the disc 9. In order to achieve oil-tightness of the ring 11 against the disc 9, the outer tube of each blast-pipe is threaded externally in a region 13 underneath the bottom plate 1 and receives at this level a clamp-nut 14 which is manipulated to apply the ring 11 tightly against the disc 9.

Figure 3:
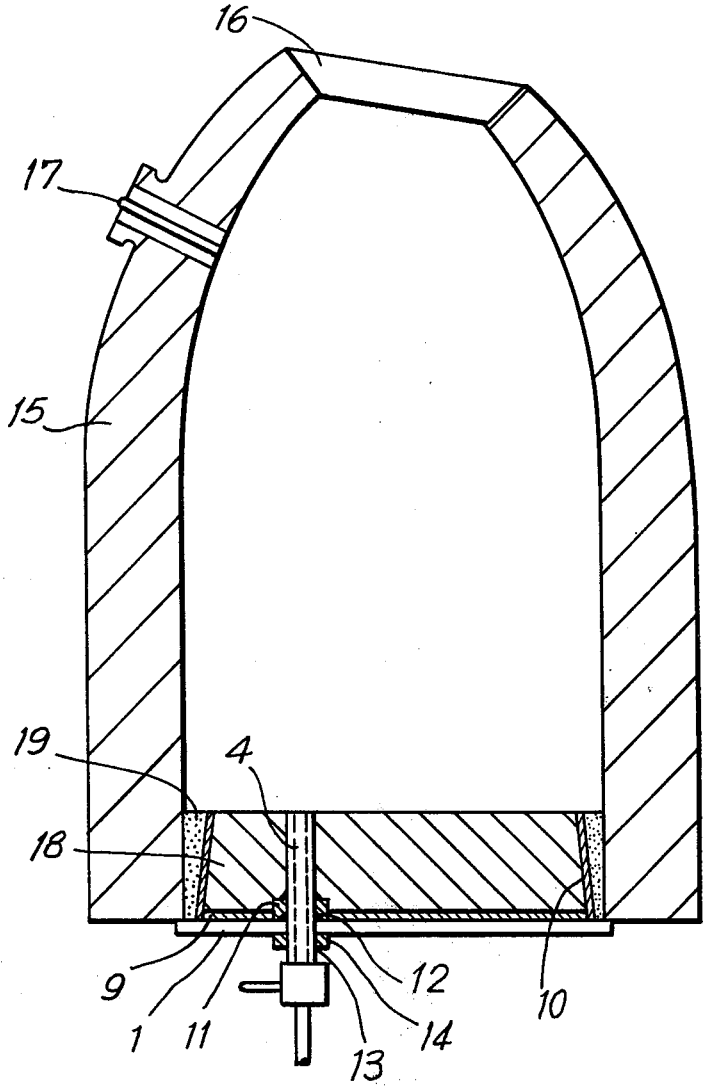
FIG. 3 is a vertical section through a converter including the cup of FIG. 2.

The retainer cup shown in FIG. 2 is shown in FIG. 3 in a converter comprising a mouth 16, a discharge opening 17 and a refractory base 18 provided with a plurality of double blast-pipes 4, of which only one is shown. Base 18 is supported by base plate 1.

As described with reference to FIG. 2, the retainer cup comprises circular disc 9 onto which is cold crimped a thin sheet 10 surrounding the base 18. Between the sheet 10 and the refractory cladding 15 of the converter there is provided the usual joint 19 of refractory material, e.g. tarred dolomite.

The fluid tightness of each blast-pipe is obtained as described with reference to FIG. 2.

Of course one can without departing from the scope of the invention conceive of variants or improvements in detail as well as the use of equivalent means. For example, the tubes 5 in FIG. 1 may be replaced by the rings 11 shown in FIG. 2 and the rings 11 in FIG. 2 may be replaced by the tubes 5 shown in FIG. 1.

As will be understood, the advantage of a device as above described in accordance with the invention is to collect all the hydrocarbons and tars running through the refractory bottom and obstruct their escape from the converter, so as to compel them to impregnate thoroughly the refractory material contituting the converter bottom.

What we claim is:

1. A device for retention of hydrocarbons in the bottom of a steelworks converter including blast-pipes protected by a flow of hydrocarbons, said device comprising a retainer cup comprising a disc of the same dimensions as the bottom plate of the converter and laid on the bottom plate and a strip bent into a cylinder of the same dimensions as the bottom plate, engaged with the periphery of said disc and extending upwardly from said disc, and an annular member in respect of each blast pipe, welded to and surrounding the respective blast pipe above said disc and engaged in a fluid tight manner with the upper surface of said disc.

2. A device as claimed in claim 1, wherein the lower end of each said annular member is formed with a recess receiving a seal and each said annular member is held against said disc by a threaded member beneath said bottom plate which is engaged on a threaded portion of the respective blast pipe.

3. A device as claimed in claim 1, wherein material of the cup is selected from the group of materials comprising sheet steel, sheet aluminium, sheet aluminium alloy, cardboard, paper and plastics material.

4. A device for retention of hydrocarbons in the bottom of a steelworks converter having a bottom plate, and blast-pipes extending through the bottom plate and protected by a flow of hydrocarbons, said device comprising a prefabricated retainer cup mounted on the bottom plate of said converter, said retainer cup comprising a thin disc of the same size as said converter bottom plate and placed on the bottom plate to form the bottom of said cup, and a strip bent into a cylinder of the same diameter as said bottom plate and said disc, said strip being cold-crimped onto said disc, said cup being placed as a unit on said bottom plate.

5. A device as claimed in claim 4 comprising a ring welded to each blast-pipe at the outer peripheral surface thereof, each ring being engaged with the bottom of the retainer cup, each said ring having lower surface with a recess therein, a seal ring in said recess, and a nut arranged underneath the bottom plate and engaged on a threaded portion of the respective blast-pipe to engage each seal ring on the bottom of the retainer cup in an oil-tight manner.

6. A device as claimed in claim 4 wherein said cup is made of a material selected from the group consisting of sheet steel, sheet aluminum, sheet aluminum alloy, cardboard, paper and plastic material.

7. A device for retention of hydrocarbons in the bottom of a steelworks converter having a bottom plate and blast-tubes extending through the bottom plate and protected by a flow of hydrocarbons, said device comprising a retainer cup comprising a cylindrical sheet having substantially the same diameter as the bottom plate and welded thereto so as to be upstanding on the bottom plate, a tube surrounding each blast-tube and welded to said bottom plate, each tube having a height corresponding to that of the cylindrical sheet of said retainer cup, and a baffle secured to each blast-tube adjacent the upper end of each of the tubes welded to the bottom plate, each baffle being of curved umbrella shape to cover the respective tube welded to the bottom plate to obstruct entry of hydrocarbons thereinto.

8. A device as claimed in claim 7 comprising filling means between each blast-tube and the surrounding tube welded to the bottom plate.

* * * * *